US011350727B1

(12) United States Patent
Schantz

(10) Patent No.: US 11,350,727 B1
(45) Date of Patent: Jun. 7, 2022

(54) BAG GRIPPING DEVICE

(71) Applicant: John J. Schantz, Swartz Creek, MI (US)

(72) Inventor: John J. Schantz, Swartz Creek, MI (US)

( * ) Notice: Subject to any disclaimer, the term of this patent is extended or adjusted under 35 U.S.C. 154(b) by 105 days.

(21) Appl. No.: 17/083,372

(22) Filed: Oct. 29, 2020

Related U.S. Application Data

(60) Provisional application No. 62/971,613, filed on Feb. 7, 2020.

(51) Int. Cl.
*B65D 63/18* (2006.01)
*A45F 5/10* (2006.01)

(52) U.S. Cl.
CPC .... *A45F 5/1046* (2013.01); *A45F 2005/1013* (2013.01)

(58) Field of Classification Search
CPC ..... A45F 5/1046
USPC ..... 294/25, 137, 171
See application file for complete search history.

(56) References Cited

U.S. PATENT DOCUMENTS 2,274,605 A * 2/1942 Hoffmeister ..... A45C 13/26 294/171
3,338,028 A * 8/1967 Freeman ..... A01K 13/007 54/82
4,262,385 A * 4/1981 Norman ..... A45F 5/10 294/149
5,560,083 A * 10/1996 Teixeira ..... A45C 13/26 190/115
D394,956 S * 6/1998 Fruecht ..... 294/171
5,867,868 A * 2/1999 Ward ..... A63B 60/10 294/171
D448,663 S * 10/2001 Raftree ..... D9/434
D530,592 S * 10/2006 Poon ..... D8/306
9,326,588 B2 * 5/2016 Jones ..... A45F 5/10
D929,382 S * 8/2021 Gwyn ..... D14/251
2003/0131447 A1 * 7/2003 Mikus ..... A45F 5/1046 16/422
2014/0302287 A1 * 10/2014 Lehtonen ..... A45C 13/001 428/192

* cited by examiner

*Primary Examiner* — Paul T Chin
(74) *Attorney, Agent, or Firm* — Buckert Patent & Trademark Law Firm PC; John F. Buckert

(57) ABSTRACT

A bag gripping device includes a flexible bag gripping member having a top end portion, a bottom end portion, and first and second side end portions. The flexible bag gripping member includes first and second primary surfaces. The device includes a flexible hand-strap member having first and second end portions. The first end portion is coupled to the first primary surface at the first side end portion. The second end portion is coupled to the first primary surface at the second side end portion. The device includes a first hook-and-loop portion that is coupled to the first primary surface at the bottom end portion. The device includes a second hook-and-loop portion that is coupled to the second primary surface at the top end portion and is removably coupled to the first hook-and-loop portion such that the flexible bag gripping member holds a handle of a bag thereon.

16 Claims, 6 Drawing Sheets

BAG GRIPPING DEVICE

CROSS-REFERENCE TO RELATED APPLICATION

This application claims priority to U.S. Provisional Patent Application No. 62/971,613 filed on Feb. 7, 2020, the entire contents of which are hereby incorporated by reference herein.

BACKGROUND

A problem with utilizing multiple shopping bags is that it can be cumbersome to reach into a vehicle or a grocery cart and to grab the handles of several of the shopping bags at one time. Further, since each of the shopping bags typically has an open end, items in the shopping bags can become dislodged from the bags and freely roll around in the grocery cart or the vehicle.

The inventor herein has recognized a need for a bag gripping device that can hold the handles of multiple shopping bags that eliminates the above-mentioned problems.

SUMMARY

A bag gripping device in accordance with an exemplary embodiment is provided. The bag gripping device includes a flexible bag gripping member having a top end portion, a bottom end portion, and first and second side end portions. The flexible bag gripping member extends along a longitudinal axis that passes through the top end portion and the bottom end portion. The flexible bag gripping member further includes first and second primary surfaces disposed opposite to one another. The bag gripping device further includes a flexible hand-strap member having first and second end portions. The first end portion is coupled to the first primary surface at the first side end portion. The second end portion is coupled to the first primary surface at the second side end portion. The bag gripping device further includes a first hook-and-loop portion that is coupled to the first primary surface at the bottom end portion. The bag gripping device further includes a second hook-and-loop portion that is coupled to the second primary surface at the top end portion. The second hook-and-loop portion is removably coupled to the first hook-and-loop portion such that the flexible bag gripping member holds a handle of a bag thereon.

A method for holding a bag in accordance with another exemplary embodiment is provided. The method includes providing a bag gripping device having a flexible bag gripping member, a flexible hand-strap member, and first and second hook-and-loop portions. The flexible bag gripping member has a top end portion, a bottom end portion, and first and second side end portions. The flexible bag gripping member extends along a longitudinal axis that passes through the top end portion and the bottom end portion. The flexible bag gripping member further includes first and second primary surfaces disposed opposite to one another. The flexible hand-strap member has first and second end portions. The first end portion is coupled to the first primary surface at the first side end portion. The second end portion is coupled to the first primary surface at the second side end portion. The first hook-and-loop portion is coupled to the first primary surface at the bottom end portion. The second hook-and-loop portion is coupled to the second primary surface at the top end portion. The method further includes disposing a portion of a human hand on the first primary surface of the flexible bag gripping member such that human hand at least partially extends through an air gap between the first primary surface and the flexible hand-strap member. The method further includes disposing a handle of a bag on the second primary surface of the flexible bag gripping member. The method further includes folding the flexible bag gripping member into a tubular shape and disposing the second hook-and-loop portion against the first hook-and-loop portion to removably couple the second hook-and-loop portion to the first hook-and-loop portion.

DETAILED DESCRIPTION

Referring to FIGS. 1-7, a user 30 having a human hand 32, a bag gripping device 40, and bags 50, 52 are illustrated. The user 30 utilizes the bag gripping device 40 to comfortably hold the bags 50, 52 in the human hand 32. The bags 50, 52 each have items stored therein.

An advantage of the bag gripping device 40 is at the device 40 allows a user to easily grab the handles of the bags 50, 52 at one time. Further, the bag gripping device 40 allows a user to close the open ends of the bags 50, 52 to prevent items in the bags 50, 52 from becoming dislodged and freely rolling around in a grocery cart or a vehicle.

Figure 8:
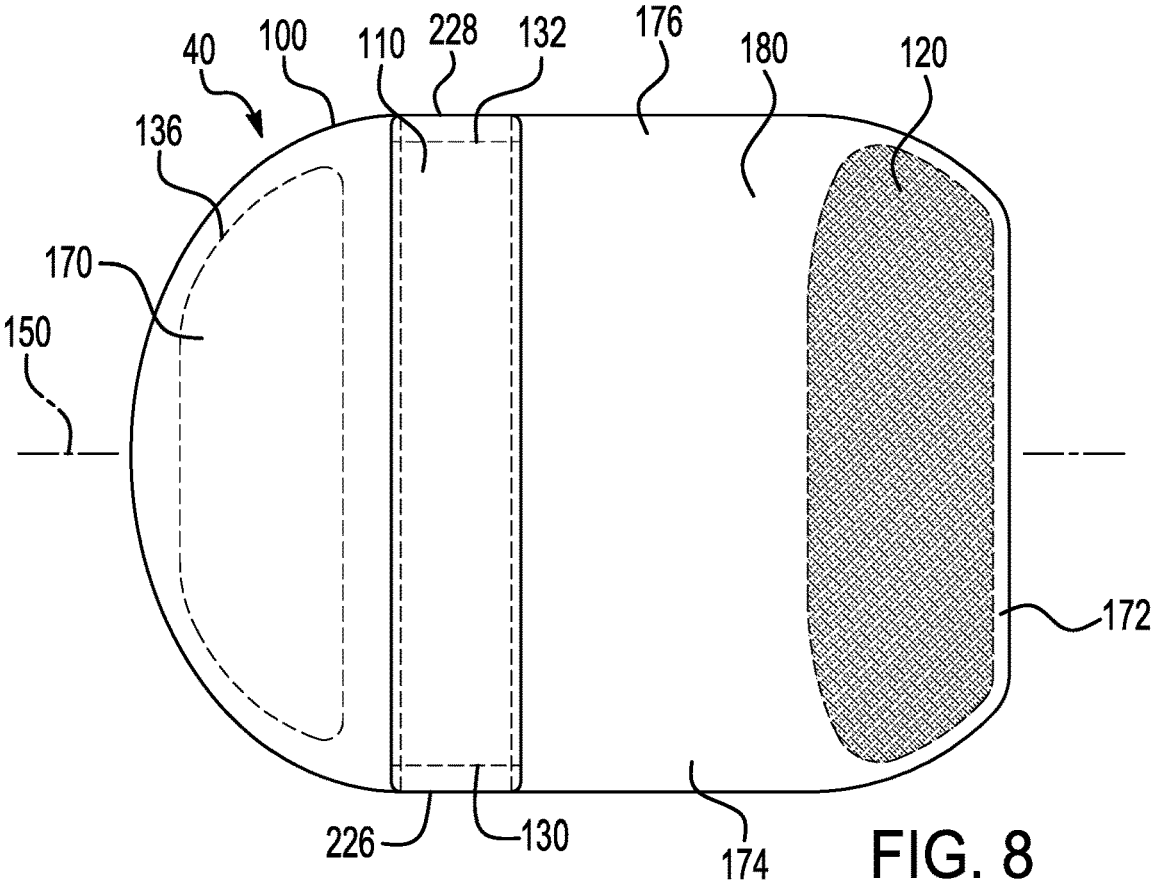
FIG. 8 is a top view of the bag gripping device in accordance with an exemplary embodiment.
Figure 9:
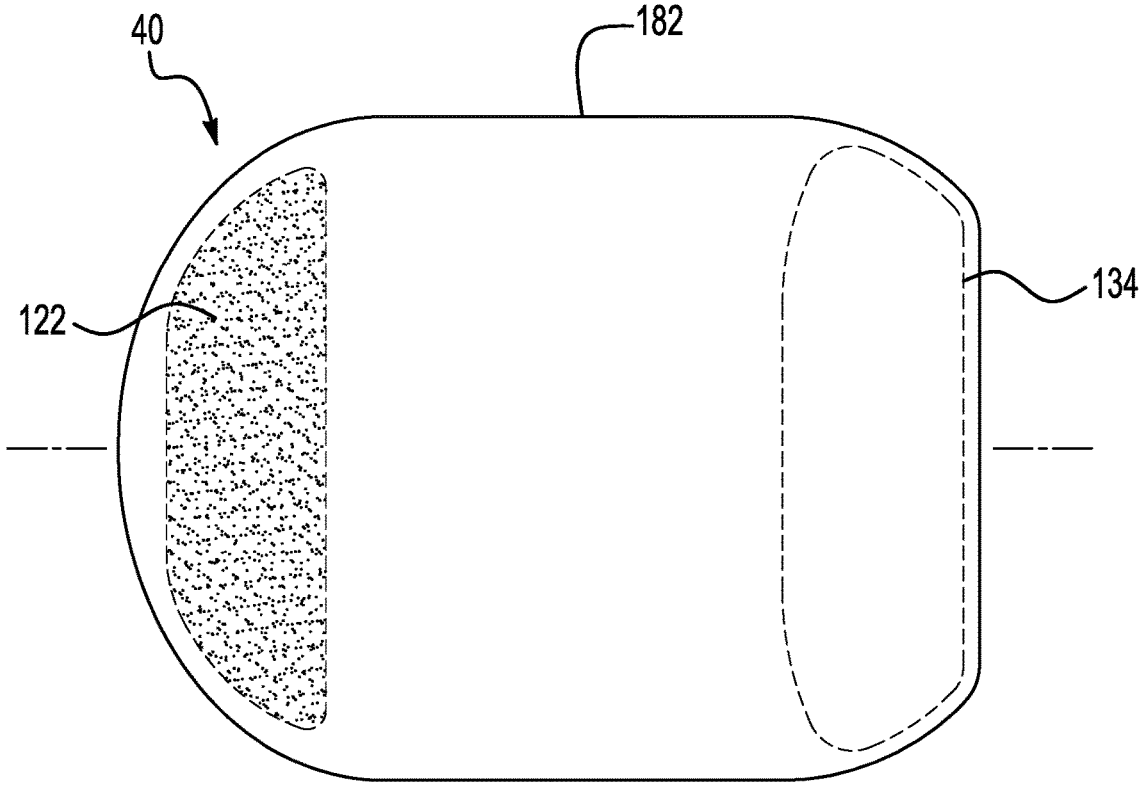
FIG. 9 is a bottom view of the bag gripping device of FIG. 8.
Figure 10:
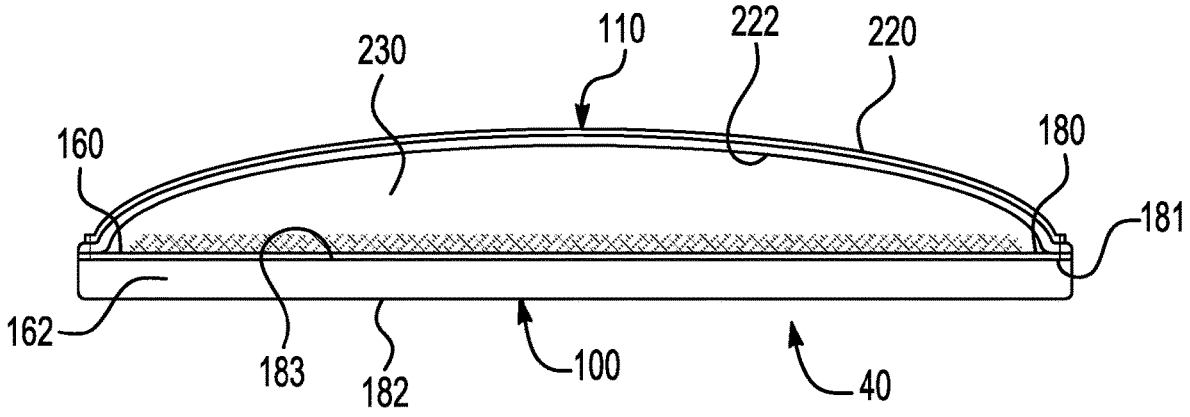
FIG. 10 is a side view of the bag gripping device of FIG. 8.
Figure 11:
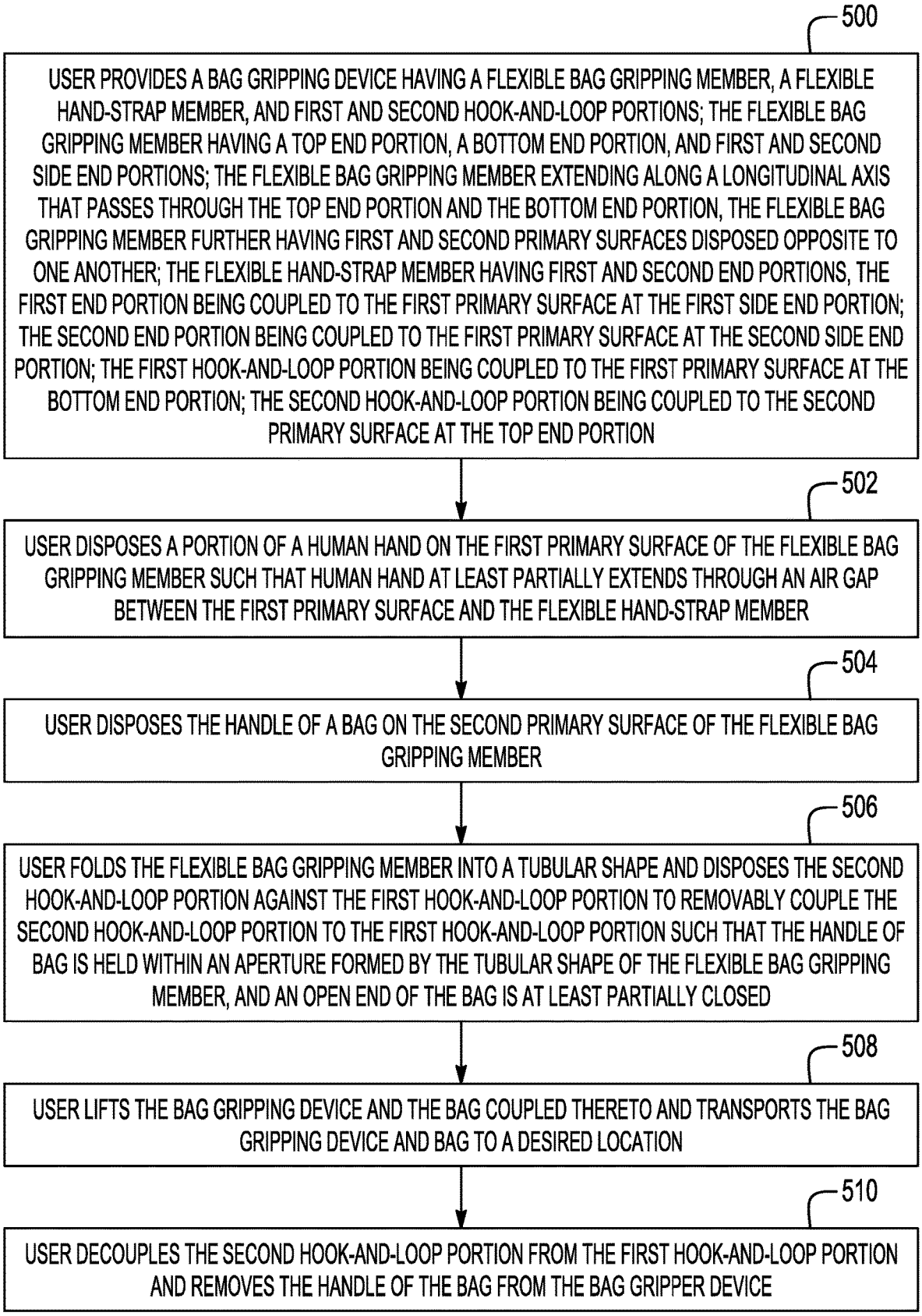
FIG. 11 is a flowchart of a method for holding a bag utilizing the bag gripping device of FIG. 8 in accordance with another exemplary embodiment.

Referring to FIGS. 8-10, the bag gripping device 40 includes a flexible bag gripping member 100, a flexible hand-strap member 110, a first hook-and-loop portion 120, a second hook-and-loop portion 122, and stitches 130, 132, 134, 136.

The flexible bag gripping member 100 includes a cover layer 160, a flexible layer 162, a top end portion 170, a bottom end portion 172, and first and second side end portions 174, 176. The flexible bag gripping member 100 extends along a longitudinal axis 150 that passes through the top end portion 170 and the bottom end portion 172. The top end portion 170 is arcuate-shaped.

The cover layer 160 includes a first primary surface 180 and an attachment surface 181. The first primary surface 180 is sized and shaped to cover a palm of the human hand 32. In an exemplary embodiment, the cover layer 160 is constructed of at least one of a flexible open cell foam material and a flexible closed cell foam material.

The flexible layer 162 includes a second primary surface 182 and an attachment surface 183. The attachment surface 183 of the flexible layer 162 is coupled to the attachment surface 181 of the cover layer 160. Further, the second primary surface 182 of the flexible layer 162 is disposed opposite to the first primary surface 180 of the cover layer 160. In an exemplary embodiment, the flexible layer 162 is constructed of at least one of a flexible open cell foam material and a flexible closed cell foam material. The second primary surface 182 is utilized to contact the handles of the bags 50, 52 (shown in FIG. 3).

Referring to FIGS. 5-8 and 10, the flexible hand-strap member 110 includes a cover layer 220 and a flexible layer 222 coupled to the cover layer 220. The flexible hand-strap member 110 further includes a first end portion 226 and a second end portion 228 (shown in FIG. 8). The first end portion 226 is coupled to the first primary surface 180 at the first side end portion 174 of the flexible bag gripping member 100 utilizing the stitches 130. The second end portion 228 is coupled to the first primary surface 180 at the second side end portion 176 of the flexible bag gripping member 100 utilizing the stitches 132. In an exemplary embodiment, the cover layer 220 and the flexible layer 222 are constructed of at least one of a flexible open cell foam material and a flexible closed cell foam material. The flexible hand-strap member 110 extends in a direction perpendicular to the longitudinal axis 150. Further, the flexible hand strap member 110 defines an air gap 230 (shown in FIG. 10) between the first primary surface 180 of the flexible hand-strap member 110 and the flexible bag gripping member 100 for receiving a human hand 32 (shown in FIG. 6) therethrough.

Referring to FIGS. 8 and 9, the first hook-and-loop portion 120 is coupled to the first primary surface 180 at the bottom end portion 172 of the flexible bag gripping member 100 utilizing the stitches 134 (shown in FIG. 9). In an exemplary embodiment, the first hook-and-loop portion 120 comprises a Velcro portion.

The second hook-and-loop portion 122 is coupled to the second primary surface 182 at the top end portion 170 of the flexible bag gripping member 100 utilizing the stitches 136 (shown in FIG. 8). In an exemplary embodiment, the second hook-and-loop portion 122 comprises a Velcro portion. The second hook-and-loop portion 122 is removably coupled to the first hook-and-loop portion 120 such that the flexible hand-protecting member 100 holds the handles of the bags 50, 52 (shown in FIG. 1) thereon. In particular, when the second hook-and-loop portion 122 is removably coupled to the first hook-and-loop portion 120, the flexible bag gripping member 100 forms a tubular shape having an inner aperture 240 (shown in FIG. 7) that the handles of the bags 50, 52 extend therethrough.

Figure 1:
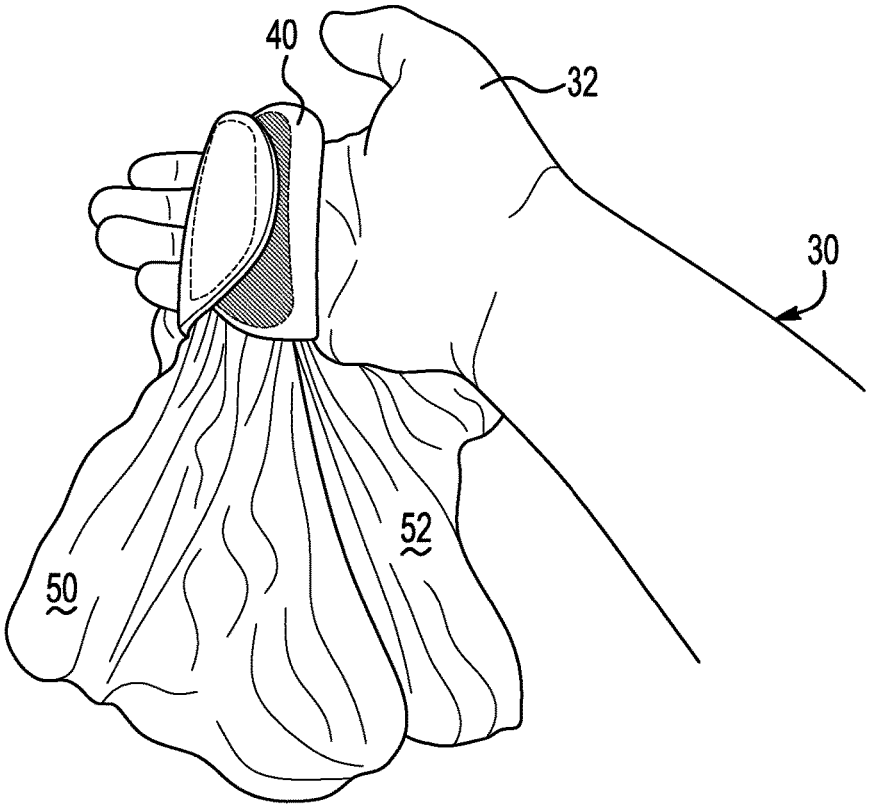
FIG. 1 is a schematic of a user's hand holding bags utilizing a bag gripping device in accordance with an exemplary embodiment.
Figure 2:
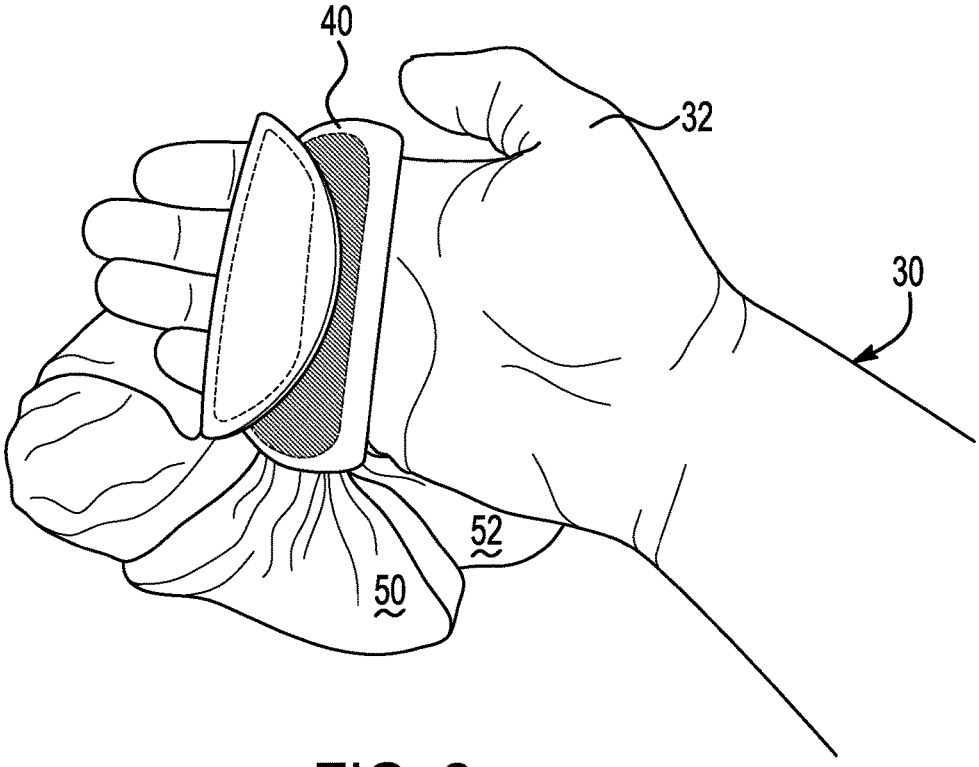
FIG. 2 is another schematic of the user's hand holding bags utilizing the bag gripping device of FIG. 1 wherein the bag gripping device has a closed operational position with a tubular shape for holding handles of bags therein.
Figure 3:
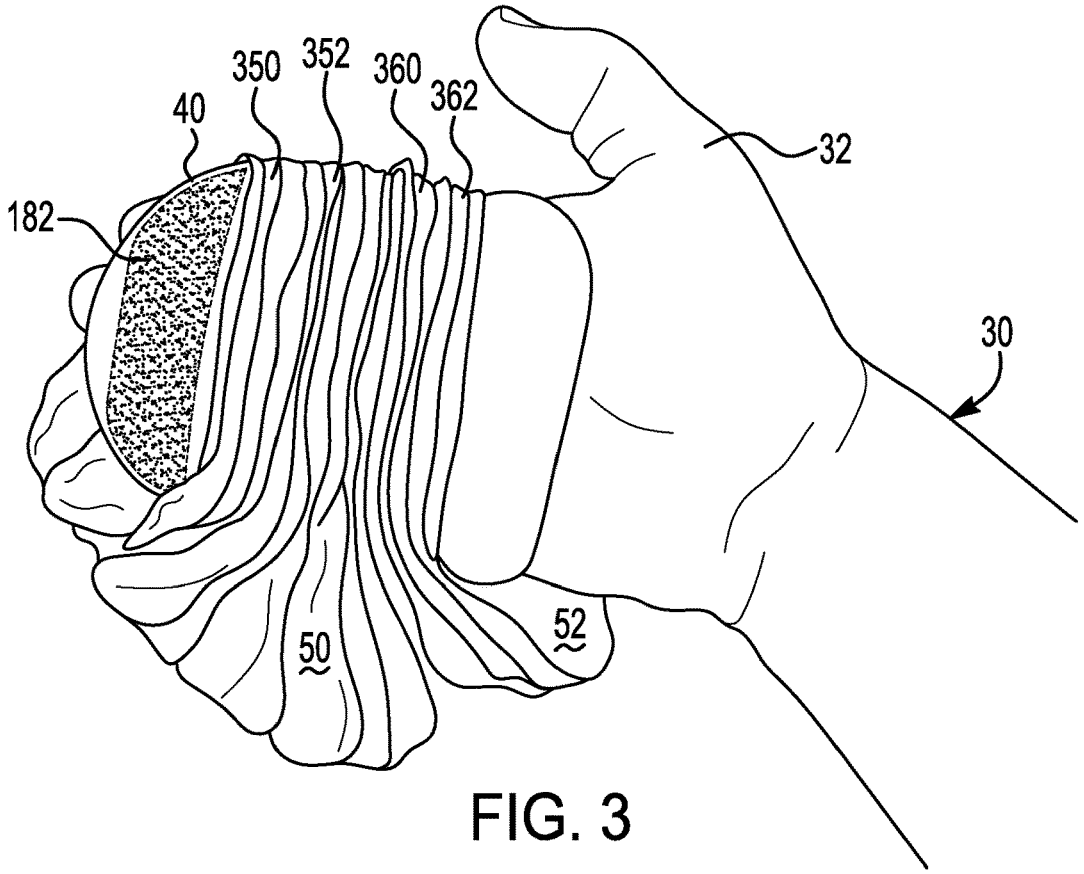
FIG. 3 is another schematic of the user's hand holding bags utilizing the bag gripping device of FIG. 1 wherein the bag gripping device has an open operational position for receiving handles of bags thereon.
Figure 4:
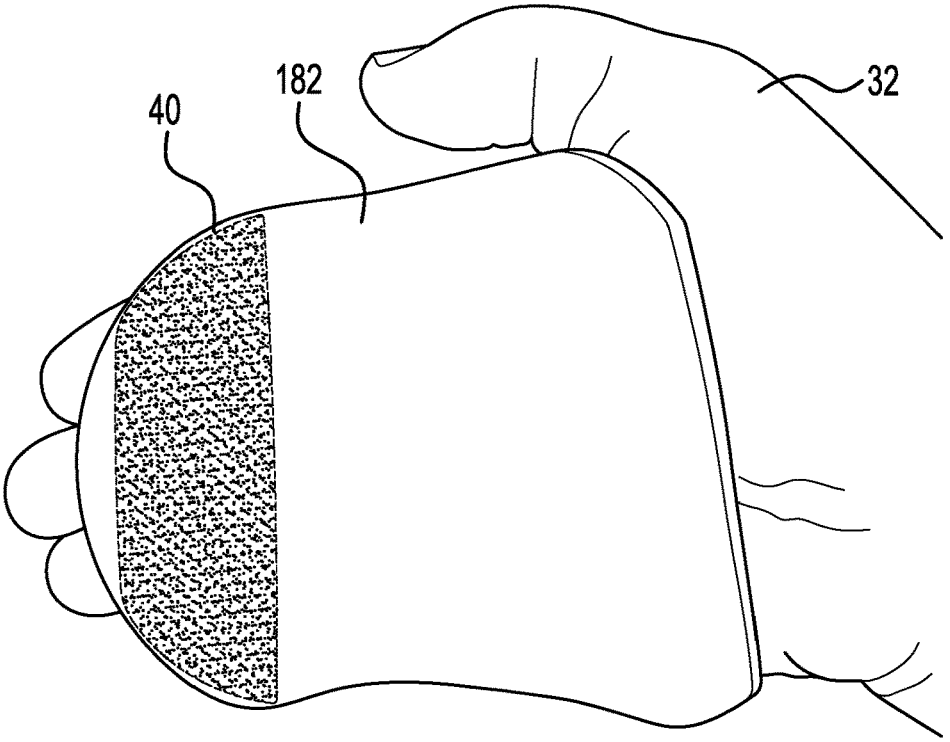
FIG. 4 is a schematic of the user's hand with the bag gripping device attached thereto wherein the bag gripping device has an open operational position.
Figure 5:
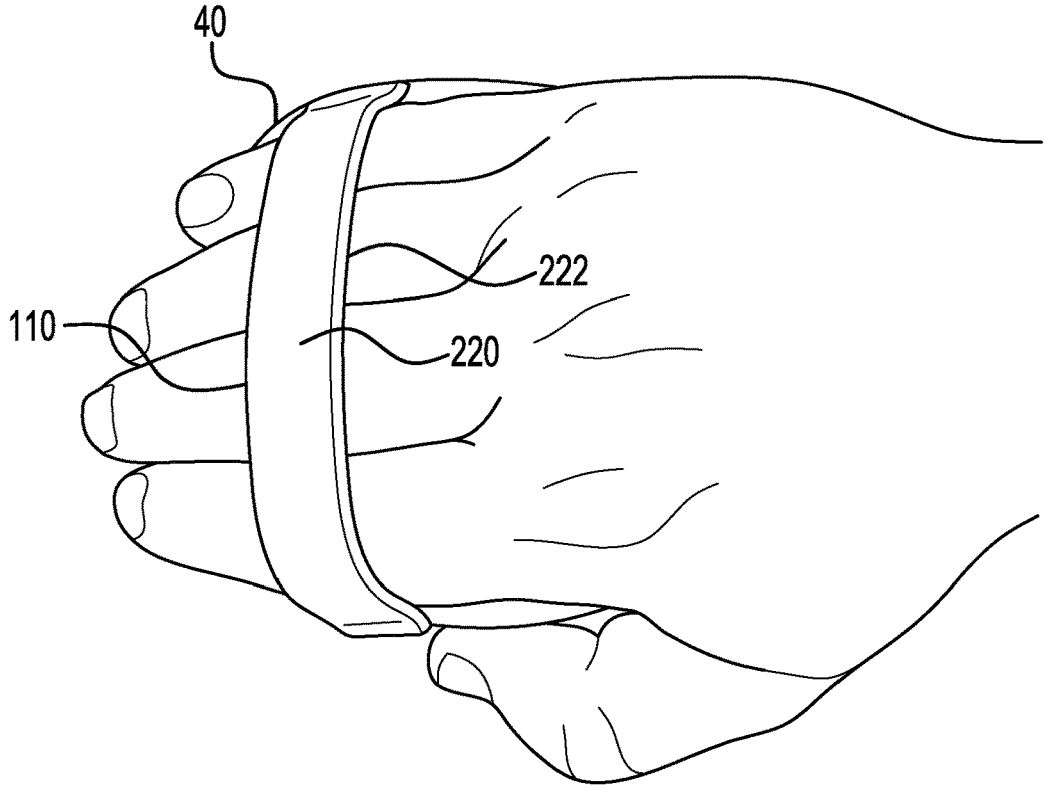
FIG. 5 is another schematic of the user's hand with the bag gripping device attached thereto.
Figure 6:
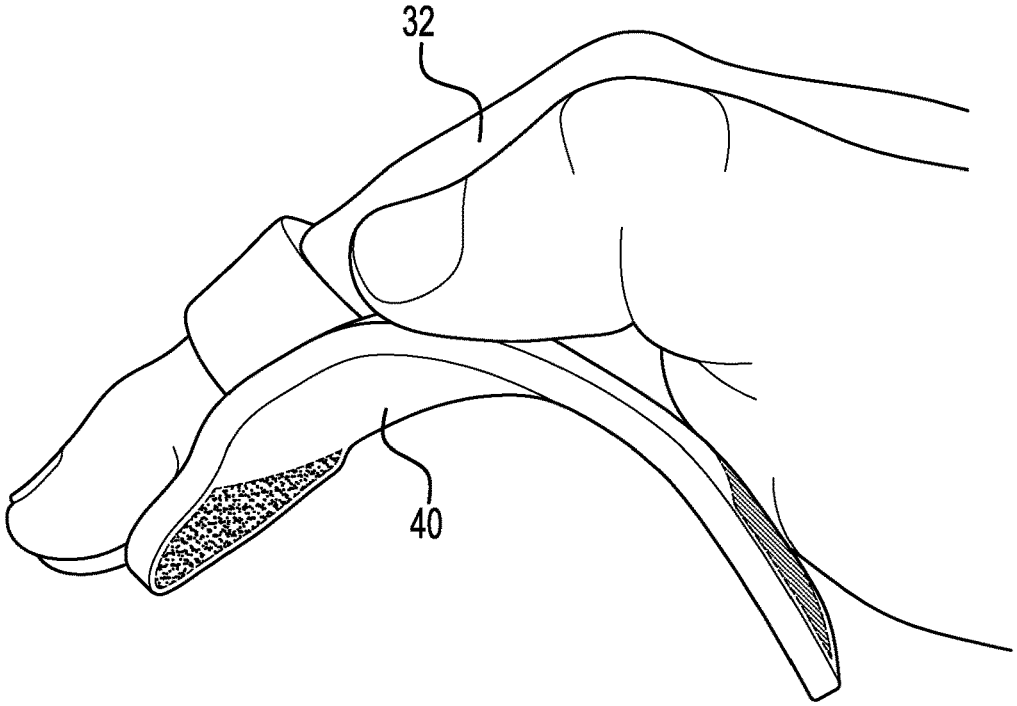
FIG. 6 is another schematic of the user's hand with the bag gripping device attached thereto.
Figure 7:
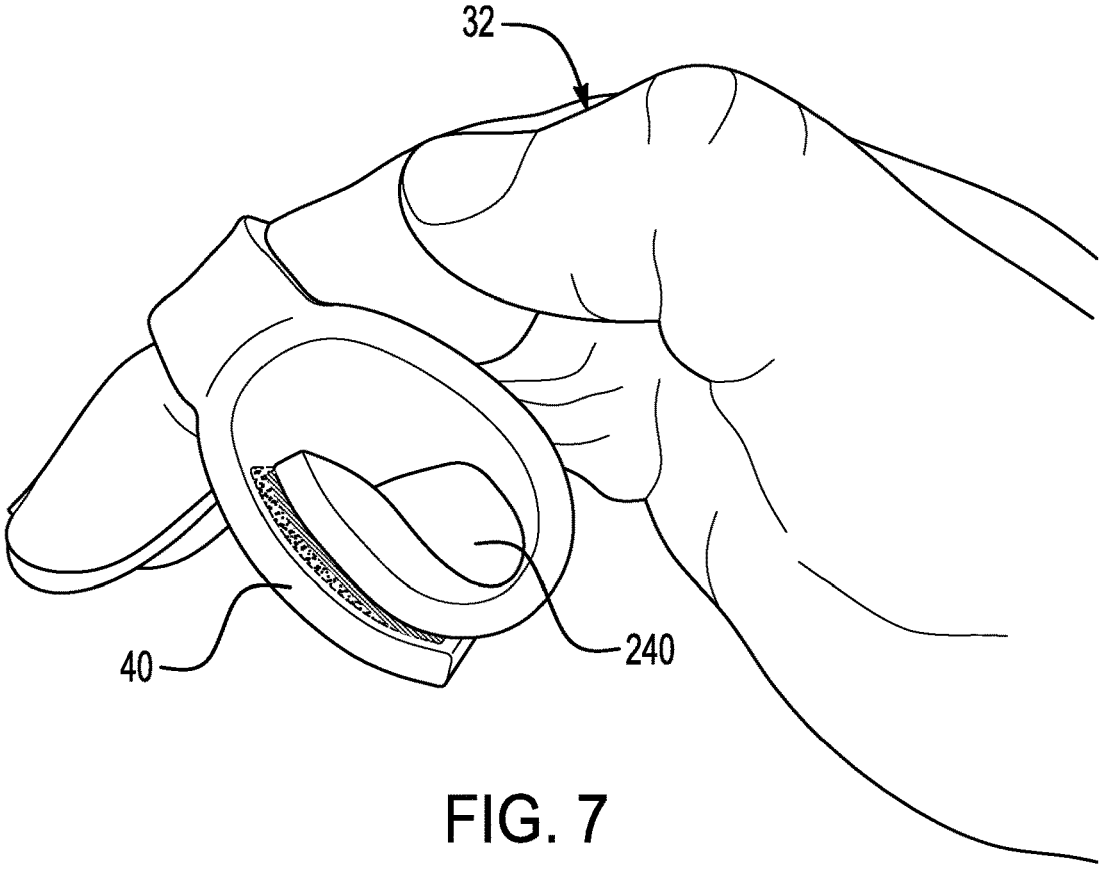
FIG. 7 is another schematic of the user's hand with the bag gripping device attached thereto wherein the bag gripping device has a closed operational position with a tubular shape.

Referring to FIG. 3, the bags 50, 52 are disposed on the bag gripping device 40. The bag 50 includes handles 350, 352 which may be disposed on the second primary surface 182 of the bag gripping device 40. The bag 52 includes handles 360, 362 which may be disposed on the second primary surface 182 of the bag gripping device 40.

Referring to FIGS. 1-5 and 8-11, a method for holding a bag 50 utilizing the bag gripping device 40 in accordance with another exemplary embodiment will now be explained.

At step 500, the user 30 provides the bag gripping device 40 having the flexible bag gripping member 100, the flexible hand-strap member 110, and first and second hook-and-loop portions 120, 122. The flexible bag gripping member 100 has the top end portion 170, the bottom end portion 172, and first and second side end portions 174, 176. The flexible bag gripping member 100 extends along the longitudinal axis 150 that passes through the top end portion 170 and the bottom end portion 172. The flexible bag gripping member 100 further includes first and second primary surfaces 180, 182 disposed opposite to one another. The flexible hand-strap member 110 has first and second end portions 226, 228. The first end portion 226 is coupled to the first primary surface 180 at the first side end portion. The second end portion 228 is coupled to the first primary surface 180 at the second side end portion 176. The first hook-and-loop portion 120 is coupled to the first primary surface 180 at the bottom end portion 172. The second hook-and-loop portion 122 is coupled to the second primary surface at the top end portion 170.

At step 502, the user 30 disposes a portion of a human hand 32 on the first primary surface 180 of the flexible bag gripping member 100 such that human hand 32 at least partially extends through an air gap 230 between the first primary surface 180 and the flexible hand-strap member 110.

At step 504, the user 30 disposes the handle 350 of the bag 50 on the second primary surface of the flexible bag gripping member 100.

At step 506, the user 30 folds the flexible bag gripping member 100 into a tubular shape and disposes the second hook-and-loop portion 122 against the first hook-and-loop portion 120 to removably couple the second hook-and-loop portion 122 to the first hook-and-loop portion 120 such that the handle 350 of bag 50 is held within an aperture 240 (shown in FIG. 7) formed by the tubular shape of the flexible bag gripping member 100, and an open end of the bag 50 is at least partially closed.

At step 508, the user 30 lifts the bag gripping device 40 and the bag 50 coupled thereto and transports the bag gripping device 40 and bag 50 to a desired location.

At step 510, the user 30 decouples the second hook-and-loop portion 122 from the first hook-and-loop portion 120 and removes the handle 350 of the bag 50 from the bag gripping device 40.

The bag gripping device 40 and the method described herein provide a substantial advantage over other devices and methods. In particular, the bag gripping device 40 allows a user to easily grab the handles of the bags 50, 52 at one time. Further, the bag gripping device 40 allows a user to close the open ends of the bags 50, 52 to prevent items in the bags 50, 52 from becoming dislodged and freely rolling around in a grocery cart or a vehicle.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A bag gripping device, comprising:

a flexible bag gripping member having a top end portion, a bottom end portion, and first and second side end portions; the flexible bag gripping member extending along a longitudinal axis that passes through the top end portion and the bottom end portion, the flexible bag gripping member further having first and second primary surfaces disposed opposite to one another;

a flexible hand-strap member having first and second end portions, the first end portion being coupled to the first primary surface at the first side end portion, the second end portion being coupled to the first primary surface at the second side end portion;

a first hook-and-loop portion being coupled to the first primary surface at the bottom end portion; and a second hook-and-loop portion being coupled to the second primary surface at the top end portion, the second hook-and-loop portion being removably coupled to the first hook-and-loop portion such that the flexible bag gripping member holds a handle of a bag thereon.

2. The bag gripping device of claim 1, wherein:

the first primary surface of the flexible bag gripping member being sized and shaped to cover a palm of a human hand.

3. The bag gripping device of claim 1, wherein:

the top end portion of the flexible bag gripping member being arcuate-shaped.

4. The bag gripping device of claim 1, wherein:

the flexible hand-strap member defines an air gap between the first primary surface of the flexible bag gripping member and the flexible hand-strap member for receiving a human hand therethrough.

5. The bag gripping device of claim 1, wherein:

the flexible hand-strap member extends in a direction perpendicular to the longitudinal axis.

6. The bag gripping device of claim 1, wherein:

the flexible bag gripping member is constructed of at least one of a flexible open cell foam material and a flexible closed cell foam material.

7. The bag gripping device of claim 1, wherein:

the flexible hand-strap member is constructed of at least one of a flexible open cell foam material and a flexible closed cell foam material.

8. The bag gripping device of claim 1, wherein:

when the second hook-and-loop portion is removably coupled to the first hook-and-loop portion, the flexible bag gripping member forms a tubular shape having an inner aperture that the handle of the bag extends therethrough.

9. A method for holding a bag, comprising:

providing a bag gripping device having a flexible bag gripping member, a flexible hand-strap member, and first and second hook-and-loop portions; the flexible bag gripping member having a top end portion, a bottom end portion, and first and second side end portions; the flexible bag gripping member extending along a longitudinal axis that passes through the top end portion and the bottom end portion, the flexible bag gripping member further having first and second primary surfaces disposed opposite to one another; the flexible hand-strap member having first and second end portions, the first end portion being coupled to the first primary surface at the first side end portion, the second end portion being coupled to the first primary surface at the second side end portion; the first hook-and-loop portion being coupled to the first primary surface at the bottom end portion; the second hook-and-loop portion being coupled to the second primary surface at the top end portion;

disposing a portion of a human hand on the first primary surface of the flexible bag gripping member such that human hand at least partially extends through an air gap between the first primary surface and the flexible hand-strap member;

disposing a handle of a bag on the second primary surface of the flexible bag gripping member; and folding the flexible bag gripping member into a tubular shape and disposing the second hook-and-loop portion against the first hook-and-loop portion to removably couple the second hook-and-loop portion to the first hook-and-loop portion.

10. The method of claim 9, wherein:

the first primary surface of the flexible bag gripping member being sized and shaped to cover a palm of a human hand.

11. The method of claim 9, wherein:

the top end portion of the flexible bag gripping member being arcuate-shaped.

12. The method of claim 9, wherein:

the flexible hand-strap member defines an air gap between the first primary surface of the flexible bag gripping member and the flexible hand-strap member for receiving a human hand therethrough.

13. The method of claim 9, wherein:

the flexible hand-strap member extends in a direction perpendicular to the longitudinal axis.

14. The method of claim 9, wherein:

the flexible bag gripping member is constructed of at least one of a flexible open cell foam material and a flexible closed cell foam material.

15. The method of claim 9, wherein:

the flexible hand-strap member is constructed of at least one of a flexible open cell foam material and a flexible closed cell foam material.

16. The method of claim 9, wherein:

when the second hook-and-loop portion is removably coupled to the first hook-and-loop portion, the flexible bag gripping member forms a tubular shape having an inner aperture that the handle of the bag extends therethrough.

* * * * *